US005099463A

United States Patent [19]

Lloyd et al.

[11] Patent Number: 5,099,463

[45] Date of Patent: Mar. 24, 1992

[54] PORTABLE ELECTRONIC MEDICATION DOSAGE INSTRUCTION AND ALARM DEVICE

[76] Inventors: Harry A. Lloyd, 11101 Sweetwood La., Oakton, Va. 22124; Timothy Jones, 17 Court St. P.O. Box 160, Windsor, Va. 23487; Dan C. Dunn, 23 Hearthstone Rd., Monroe, Conn. 06468

[21] Appl. No.: 694,786

[22] Filed: May 2, 1991

[51] Int. Cl.[5] ..... G04B 47/00; A47B 67/02

[52] U.S. Cl. ..... 368/10; 221/2; 221/15

[58] Field of Search ..... 368/10, 72–74, 368/107–113; 221/213, 15

[56] References Cited

U.S. PATENT DOCUMENTS 3,762,601 10/1973 McLaughlin ..... 221/2
4,258,354 3/1981 Carmon et al. ..... 340/309
4,483,626 11/1984 Noble ..... 368/10
4,490,711 12/1984 Johnston ..... 340/309
4,626,105 12/1986 Miller ..... 368/10
4,725,999 2/1986 Tate ..... 368/10
4,748,600 5/1988 Urquhart ..... 368/10
4,768,177 8/1988 Kehr et al. ..... 368/10

*Primary Examiner*—Vit W. Miska
*Attorney, Agent, or Firm*—Parkhurst, Wendel & Rossi

[57] ABSTRACT

A medication dosage instruction and alarm device that indicates the time at which medication should be taken and visual instructions for the correct utilization of the medication to the user. The instruction and alarm device permits the medication to be retained within the original containers supplied by the pharmacist and provides a queuing feature that insures the medications are properly taken in sequence. A mechanism is also provided to insure that the original containers are properly restored after the medication has been taken.

9 Claims, 5 Drawing Sheets

PORTABLE ELECTRONIC MEDICATION DOSAGE INSTRUCTION AND ALARM DEVICE

FIELD OF THE INVENTION

The invention relates generally to devices that monitor and notify a person of the correct time to take a medication. More specifically, the invention provides a medication dosage instruction and alarm device that not only indicates the time at which medication should be taken, but also provides visual instructions to the user for the correct utilization of the medication. In addition, the medication dosage instruction and alarm device permits the medication to be retained within the original containers supplied by the pharmacist.

BACKGROUND

It is necessary to have controls to prevent dangerous underdosage or overdosage of medication for patients that take multiple medications at various times of the day. Elderly patients, for example, have been documented as the greatest users of daily multiple medications and are the most likely to be confused as to whether their prescribed medication has been taken in accordance with their doctor's instructions. The confusion experienced by elderly patients can result in missed or improperly taken dosage levels. The risk of improper medication increases when there are multiple attendants responsible for the administration of the medication. Further problems may arise when the mental or physical condition of the patient has impaired his/her ability to comprehend which medications are to be taken, when the medications are to be taken, and at what dosage level the medications are to be administered.

Earlier devices designed to deal with the problem of insuring multiple medications are properly dispensed have certain deficiencies that render the reliability of such devices less than completely satisfactory. U.S. Pat. No. 4,483,626 issued to Noble, for example, discloses a medication timing and dispensing apparatus that includes a timer module and several medication containers. The user is required to remove their multiple medications from the original containers supplied by the pharmacist, sort the various medications according to dosage time, and distribute the various medications in the medication containers. The requirement for removing the medications from their original containers and sorting the medications prior to filling the medication containers of the device can cause a great deal of confusion for eldery patients thereby leading to errors. In addition, separation of the medications from their original containers also deprives the user of the availability of the dosage instructions provided on the original containers.

U.S. Pat. No. 4,626,105 issued to Miller addresses the problem of removing the medications from their respective containers by providing large compartments that can contain multiple bottles of medication. Medications that are to be taken at the same time of day are located in the same compartment. The device disclosed in Miller, however, can still cause confusion by loading multiple medication bottles within a single compartment. For example, a user may open more than one bottle at the same time and handle multiple medications of similar size and shape. If the user becomes confused when dispensing medication from the bottles, he may replace certain excess medications in the wrong bottles, thereby mixing the contents of the bottles which will cause a medication error the next time the medications within the compartment must be taken. Further, the device disclosed in Miller fails to provide a mechanism for insuring that the correct container was opened and that the medications bottles were replaced in the container.

In view of the above, it is an object of the invention to provide a medication dosage instruction and alarm device for multiple medications that does not require the medications to be removed from their original containers. It is a further object of the invention to provide a medication dosage instruction and alarm device that provides a queuing feature that insures only a single medication is taken at a time, thereby avoiding the possibility of mixing the medications. In addition, it is a still further object of the invention to provide a medication dosage instruction and alarm device that insures medication containers are properly relocated after use, prompts the user with dosage instructions, does not require resetting by the user and automatically calculates the dosage periods. Further objects and advantages of the invention will become apparent after review and study of the preferred embodiments of the invention described in detail below.

SUMMARY OF THE INVENTION

The invention provides a medication dosage instruction and alarm device that indicates the time at which medication should be taken and visual instructions for the correct utilization of the medication to the user. The instruction and alarm device permits the medication to be retained within the original containers supplied by the pharmacist and provides a queuing feature that insures the medications are properly taken in sequence. A mechanism is also provided to insure that the original containers are properly restored after the medication has been taken.

BRIEF DESCRIPTION OF THE DRAWINGS

With the above as background, reference should now be made to the following detailed description of the preferred embodiments of the invention and the accompanying drawings, in which.

DETAILED DESCRIPTION OF THE PREFERRED EMBODIMENTS

Figure 1:
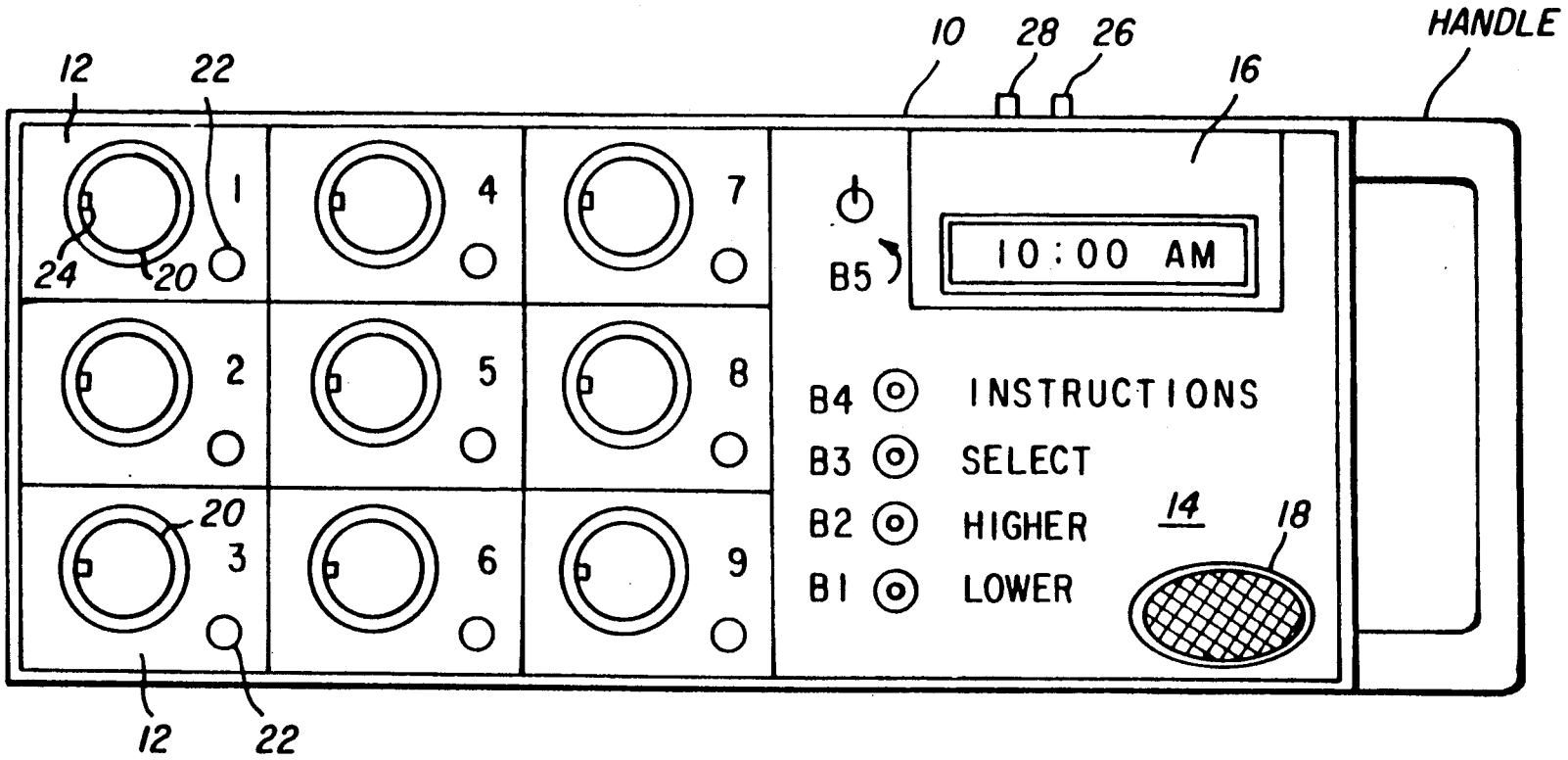
FIG. 1 illustrates a schematic top view of a medication dosage instruction and alarm device in accordance with the invention.
Figure 2:
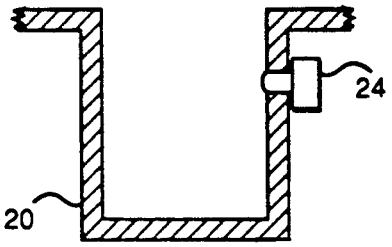
FIG. 2 illustrates a sectional side view of one of the chambers of the medication dosage instruction and alarm device shown in FIG. 1.

The invention provides a medication dosage instruction and alarm device that indicates the time at which medication should be taken and visual instructions for the correct utilization of the medication to the user, while retaining the medication within the original containers supplied by the pharmacist. As shown in FIG. 1, the medication dosage instruction and alarm device 10 includes a plurality of medication modules 12 (numbered 1-9 for programming identification purposes), a control panel 14 including a plurality of operator control buttons B1-B5, a display unit 16, and an alarm speaker 18. Each medication module 12 includes a chamber 20 designed to retain a standard size medication bottle, an indicator light 22, and a medication bottle present indicator 24 that may include, for example, a mechanical switch or optical sensor. A power jack 26 is provided so that the device 10 may be powered from an external power source (not shown). An external alarm jack 28 is also provided so that an alarm signal can be supplied to an external alarm device, for example, a room light can be controlled to flash in order to alert a hearing impaired individual. A sectional view of one of the chambers 20 is illustrated in FIG. 2.

Figure 3:
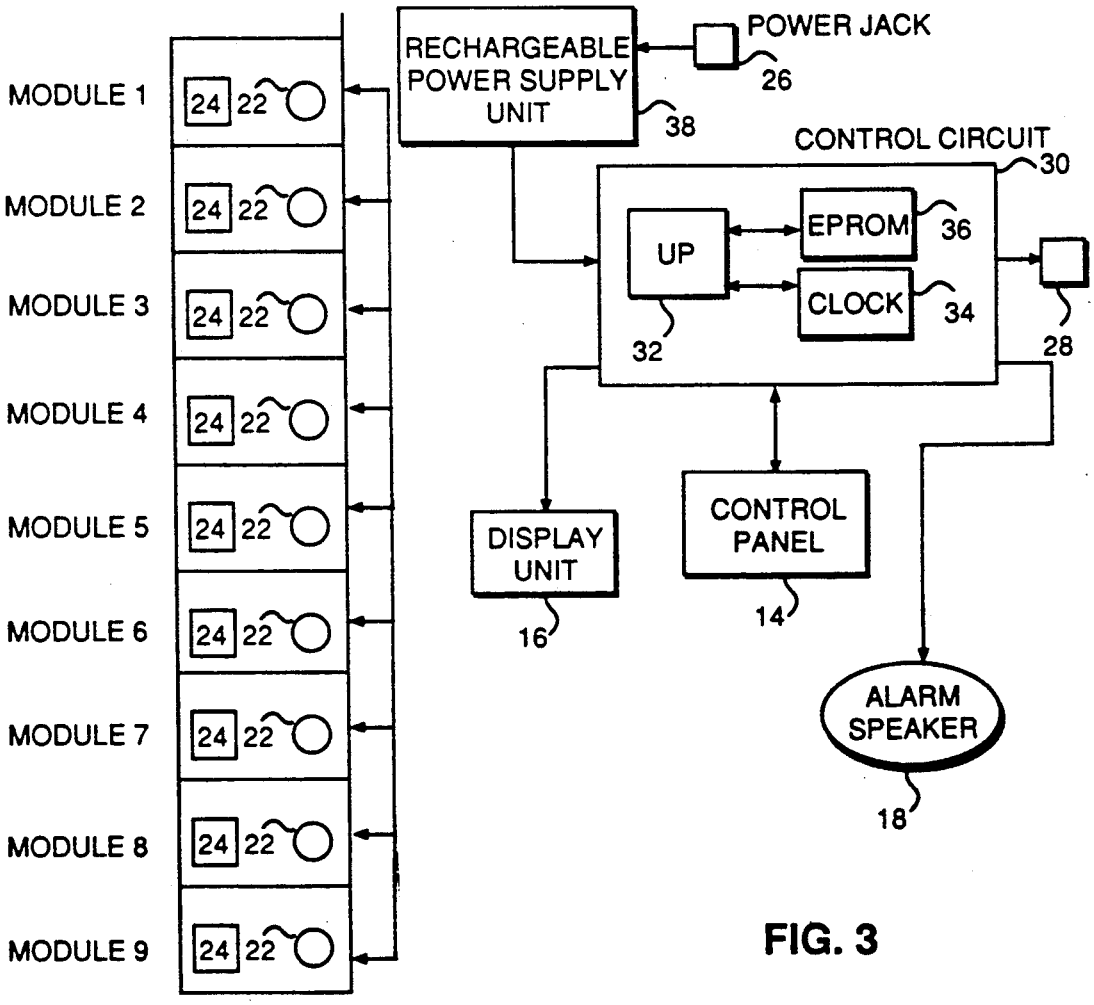
FIG. 3 illustrates a basic block diagram of an electronic circuit for the medication dosage instruction and alarm device illustrated in FIG. 1.

A basic block diagram of the electronic circuitry for the device 10 is illustrated in FIG. 3. A control circuit 30 is coupled to the indicator light 22 and medication bottle present indicator 24 of each of the medication modules 12. The control circuit 30 is also coupled to the control panel 14, display unit 16, the alarm speaker 18, and external audio alarm jack 28. The control circuit 30 includes a microprocessor 32 having its own onboard random access memory RAM, an electrically programmable read only memory EPROM coupled to the microprocessor 32, and a real time clock 34. The control circuit 30 is coupled to a rechargeable power supply unit 38, which in turn is coupled to the power jack 26. The rechargeable power supply unit 38 includes a rechargeable battery and associated regulation and recharging circuitry, such that the rechargeable power supply unit 38 supplies power to the control circuit 30 via an external source and charges the rechargeable battery when the power jack 26 is connected to the external source, and supplies power to the control circuit 30 from the rechargeable battery when the power jack is not connected to the external source.

In operation, the user loads the medication modules 12 with standard medication bottles and enters dosage times and dosages instructions into the EPROM 36 via operation of the operator control buttons B1-B5 under control of the microprocessor 32. For example, the user presses the ON/OFF button B5 to activate the device 10 after the standard medication bottles have been loaded into the medication modules 12. Once activated, the display unit 16 displays current time data that is received from the real time clock 36. The user then presses the instruction button B4. The microprocessor 32 displays the message "SET TIME" on the display unit 16 in response to the activation of the instruction button B4. The user can enter a time setting mode by pressing the select button B3 at this point in the operation of the device 10. If the user presses the select button B3, the current hour setting is displayed on the visual display 16. The user can then adjust the hour by pressing the higher/lower buttons B2 and B1 until the desired hour appears on the visual display 16. The user then presses the select button B3 to "select" or set the desired hour. The microprocessor unit 32 then increments the visual display 16 to display the current minutes. The user programs the desired minutes setting in the same way as the hour setting described above. The programming of the time is similar to setting conventional electronic clocks as is well known in the art.

The user presses the instruction button B4 a second time to enter the medication programming mode if the time is correct and does not need to be adjusted. At the second activation of the instruction button B4, the microprocessor 32 displays the message "MEDICATION MODULE 1" or "BOTTLE 1". The user then selects the desired medication module 12 to be programmed by using the higher/lower buttons B1 and B2 to adjust which medication module number is displayed. If desired, the microprocessor 32 can also cause the indicator light 22 associated with the medication module displayed on the visual display 16 to flash, thereby giving the user a further visual indication of which medication module is being selected. The select button B3 is pressed by the user when the desired medication module 12 to be programmed is displayed on the visual display 16 and the selected medication module number data is stored in the EPROM 36. After selection of a medication module 12, the microprocessor 32 displays the message "ALARM ON" on the visual display 16. The user may then select whether an audible alarm is to be generated for the selected medication module. Pressing the higher/lower buttons B1 and B2 toggles the alarm ON or OFF. The user then presses the select button B3 after the visual display 16 indicates the desired alarm condition and the alarm condition data is stored in the EPROM 36. The same basic process is repeated to program the dosage level, for example 1-10 tablets, for the selected medication module.

After programming of the dosage level has been completed, the user is given the option of setting the frequency and times of medication either manually or automatically. The microprocessor 30 displays the message "1 Per Day" on the visual display 16. The user sets the desired frequency (from 1-12 times per day) by changing the displayed number using the higher/lower buttons B1 and B2, and selects the desired frequency using the select button B3 in the same manner described above. Activation of the select button B3 causes the microprocessor 32 to automatically calculate alarm times based on a preset sixteen hour clock period, for example starting at 8:00 AM and ending at midnight, and store the calculated alarm times in the EPROM. If the user scrolls through all available frequency numbers (twelve in this case) the microprocessor 32 displays the message "MANUAL" on the visual display 16. The user selects the manual mode by pressing the select button B3 at this point. The microprocessor 32 then displays the message "ALARM 1" on the visual display 16. Once again the user can set the desired alarm number by using the higher/lower buttons B1 and B2, and can select the desired alarm by pressing the select button B3. Once an alarm number is selected, the user is permitted to program a time for the selected alarm in the same manner as the current time setting is programmed. In a preferred embodiment, up to forty-eight separate alarms can be programmed for each medication module 12 in the manual mode of operation.

Figure 4:
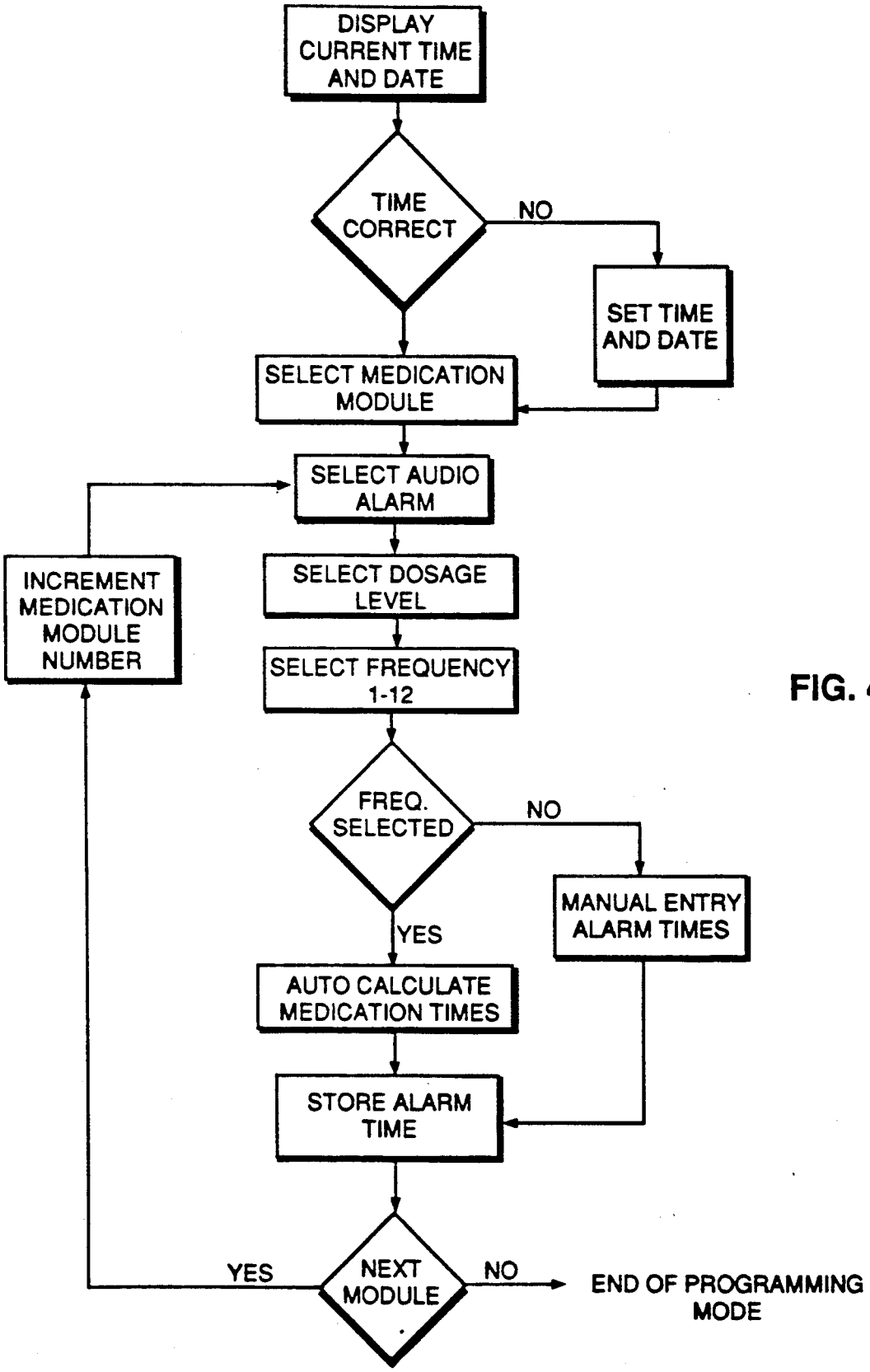
FIG. 4 is a flowchart illustrating a programming operation for the medication dosage instruction and alarm device in FIG. 1.

Once programming is completed for the first selected medication module, the user can press the instruction button B4 to return to the displaying the current time or continue with the programming of a subsequent medication module which is displayed on the display unit 11. The programming for each of the medication modules 12 is completely independent, thereby providing complete flexibility in the selection of dosage, alarm frequency, and automatic or manual alarm time settings for each of the medication modules 12. The provision of independent programming makes it easy to edit the programming information for a single medication module without disrupting the programming for the remaining medication modules. The steps involved in programming the medication information are illustrated in FIG. 4.

Figure 5:
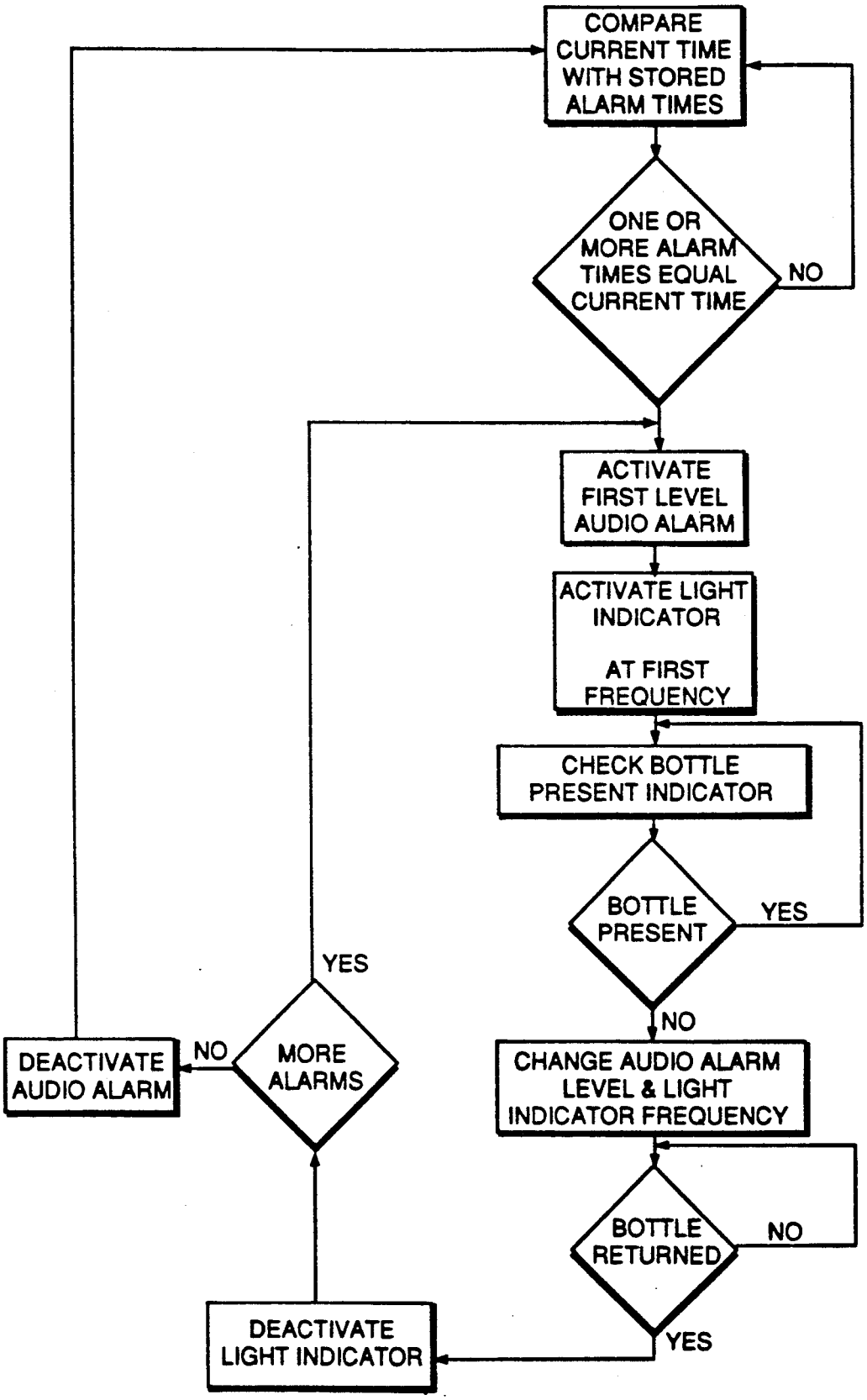
FIG. 5 is a flowchart illustrating the operation of the medication dosage instruction and alarm device illustrated in FIG. 1 after the programming operation illustrated in FIG. 4 has been completed.

Once all programming is completed, the programmed alarms will be activated by the microprocessor 32 when the current time reaches a programmed alarm time by causing the indicator light 22 for the appropriate medication module to flash, displaying the message "ALARM" on the visual display 16 and, if programmed, by activating the audio speaker 18 and external audio alarm jack 28 to issue an audible alarm. The medication bottle present indicator 24 sends a signal to the microprocessor 32 when the user removes the medication bottle from the indicated medication module. The microprocessor 32 changes the message displayed on the visual display 16 to the previously stored dosage instructions and changes the frequency of the flashing of the indicator light 22 and the tone of the audible alarm to a different, for example lower, level. The lower level alarms continue until the user replaces the medication bottle in the medication module, which causes the medication bottle present indicator 24 to send a signal to the microprocessor 32 indicating that the bottle has been replaced. The microprocessor 32 deactivates the alarms in response to the signal received from the medication bottle present indicator 24. If more than one medication is required at the same time the microprocessor 32 queues the alarms (preferably by medication module number) so that the multiple alarms are sequentially generated, i.e., the second alarm will not be generated until the user replaces the medication bottle associated with the first alarm. A general flow diagram of the above-described operation is illustrated in FIG. 5.

The medication dosage instruction and alarm device 10 provides many advantages over conventional devices including user friendly programming, audible and visual alarms, visual dosage instructions, and the above-described queuing feature that prevents the user from mixing medications. The device 10 is preferably constructed of high impact, light-weight plastic which, in combination with the rechargeable power supply, permits the device 10 to be portable.

Figure 6:
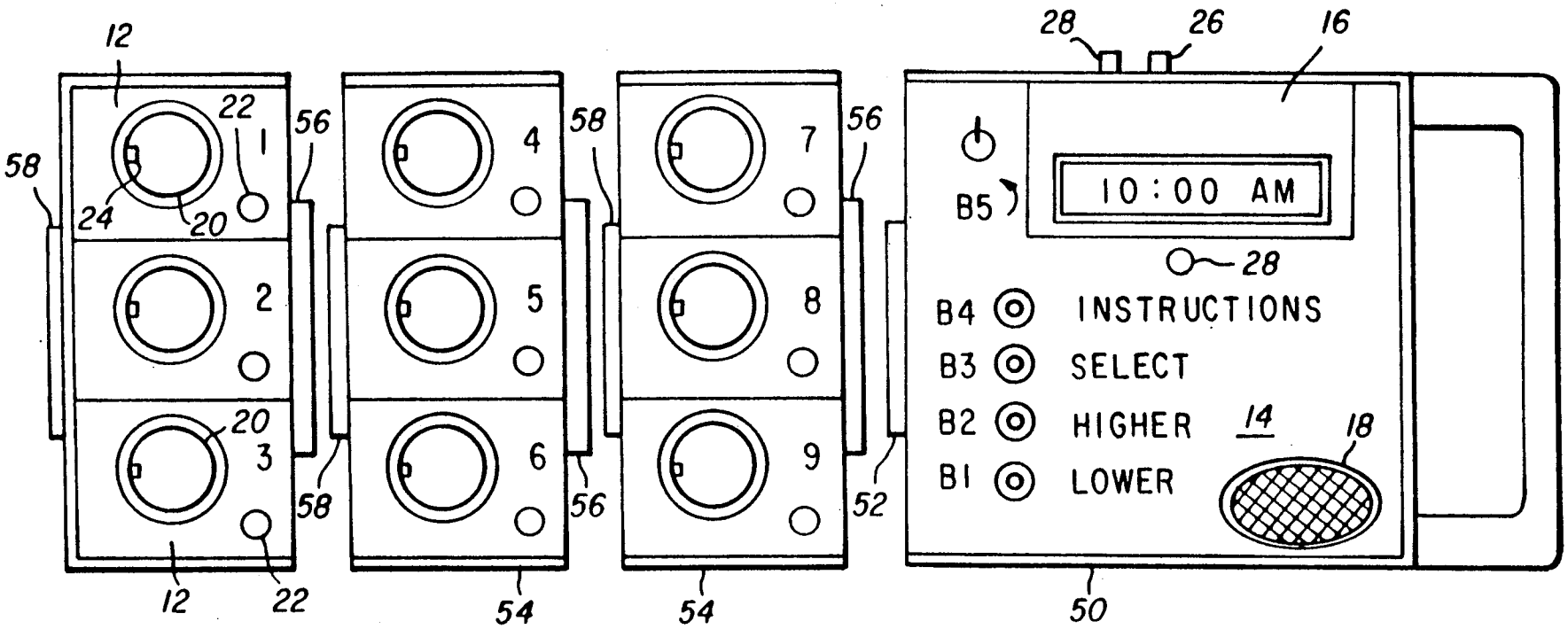
FIG. 6 illustrates a second embodiment of a medication dosage instruction and alarm device in accordance with the present invention.

Referring now to FIG. 6, a second embodiment of the invention is disclosed in which the medication modules 12 can be removed and added to configure the device to personal needs. For example, individual users have different numbers of medications that must be taken and therefore require different numbers of medication modules. In order to always keep the overall device configuration as compact as possible for each user, the control circuitry, rechargeable power supply, operator controls, etc., are located within a base housing 50 having a module connector 52 located on one side thereof. Individual medication modules or groups of medication modules can then be attached to the base unit 50 via the module connector 52. For example, as shown in FIG. 6, a medication module section 54 containing three medication modules 12 has mating connectors 56 and 58 designed to connect the medication module section 54 to the base unit 50, via the module connector 52, and to additional medication module sections. Thus, the total number of medication modules can be easily varied.

It will be understood that while the invention has been described with reference to the "user" programming the device, the "user" that performs the programming need not be the same individual that is required to take the medication. For example, the invention is particularly well suited for use by a pharmacist to fill a prescription and program the device for a medication recipient. In such a case, it may be desirable to include a key lock switch or a programmed access number that permits only the pharmacist to access the programming mode of the device.

The invention has been described with particular reference to certain preferred embodiments thereof. It will be understood, however, that modifications and variations are possible within the scope of the appended claims. For example, a keypad can be utilized instead of the higher/lower buttons to enable direct programming of time and dosage information. The sequence of programming steps can also be modified if desired. The signal provided by the external alarm jack 26 can also be utilized to activate the display of an alarm message on a television. Finally, the signals provided by the medication bottle present indicators 24 can also be stored in memory for subsequent downloading thereby enabling third party verification that the medication has been taken.

What is claimed is:

1. A medication dosage instruction and alarm device comprising:

at least one medication module including a chamber and a medication bottle present sensor for detecting whether a medication bottle is located in the chamber and generating a detection signal indicative thereof;

a control panel including at least one operator control device and a visual display unit;

an alarm indicator;

a rechargeable power supply; and control circuitry coupled to the medication bottle present sensor, the operator control device, the visual display unit and the rechargeable power supply, the control circuitry including programming means for storing at least one alarm time corresponding to the medication module during a programming mode in response to an input signal received from the operator control device and clock means for generating a real time clock signal indicative of a current time;

wherein the control circuitry compares the stored alarm time with the current time during an operating mode and activates the alarm indicator when the programmed alarm time is equal to the current time, and deactivates the alarm indicator when the detection signal generated by the medication bottle present sensor indicates that a medication bottle has been returned to the chamber.

2. The medication dosage instruction and alarm device claimed in claim 1, wherein the control circuitry stores at least one dosage message corresponding to the stored alarm time during the programming mode and displays the dosage message on the visual display unit when the alarm indicator is activated during the operating mode.

3. The medication dosage instruction and alarm device claimed in claim 1, wherein the medication module includes an indicator light that is coupled to and is activated by the control circuitry when the control circuitry activates the alarm indicator.

4. The medication dosage instruction and alarm device claimed in claim 2, wherein said programming means includes a microprocessor coupled to an electrically programmable read only memory and the clock means includes a real time clock generation circuit.

5. The medication dosage instruction and alarm device claimed in claim 4, wherein the microprocessor calculates a plurality of alarm times based on frequency data entered via the operator control device and stores the alarm times in the electrically programmable read only memory.

6. The medication dosage instruction and alarm device claimed in claim 1, wherein the alarm indicator generates an audible alarm.

7. The medication dosage instruction and alarm device claimed in claim 1, wherein the control circuitry activates the alarm indicator to generate a first level alarm when the alarm time is equal to the current time and activates the alarm indicator to generate a second level alarm when the detection signal generated by the medication bottle present sensor indicates that a medication bottle has been removed from the chamber.

8. The medication dosage instruction and alarm device claimed in claim 1, further comprising an external power jack coupled to the rechargeable power supply.

9. A medication dosage instruction and alarm device comprising:

a plurality of medication modules, each medication module including a chamber, an indicator light, and a medication bottle present sensor for detecting whether a medication bottle is located in the chamber and for generating a detection signal indicative thereof;

a control panel including at least one operator control device and a visual display unit;

an alarm indicator;

a rechargeable power supply; and control circuitry coupled to each medication module, the control panel and the rechargeable power supply, the control circuitry including programming means for storing at least one alarm time corresponding to each medication module during a programming mode in response to an input signal received from the operator control device and clock means for generating a real time clock signal indicative of a current time;

wherein the control circuitry compares the stored alarm time for each of the medication modules with the current time during an operating mode and activates the alarm indicator when the stored alarm time for at least one of the medication modules is equal to the current time;

wherein the control circuitry activates the light indicator of each medication module having a stored alarm time equal to the current time in a predetermined sequence in response to detection signals received from the bottle present indicator sensors thereof after the alarm indicator has been activated.

* * * * *